US011401073B2

(12) United States Patent
Lantz et al.

(10) Patent No.: US 11,401,073 B2
(45) Date of Patent: Aug. 2, 2022

(54) WOODEN PALLET WITH BUTTED DECK BOARDS AND METAL BRACKET SUPPORTS

(71) Applicant: CHEP Technology Pty Limited, Sydney (AU)

(72) Inventors: Danel J Lantz, Orlando, FL (US); Bart De Laender, Bruges (BE); Monika Milewska, Warsaw (PL)

(73) Assignee: CHEP Technology Pty Limited, Sydney (AU)

( * ) Notice: Subject to any disclaimer, the term of this patent is extended or adjusted under 35 U.S.C. 154(b) by 0 days.

(21) Appl. No.: 16/515,164

(22) Filed: Jul. 18, 2019

(65) Prior Publication Data

US 2020/0031523 A1 Jan. 30, 2020

Related U.S. Application Data

(60) Provisional application No. 62/702,430, filed on Jul. 24, 2018.

(51) Int. Cl.
*B65D 19/00* (2006.01)

(52) U.S. Cl.
CPC ..... *B65D 19/0071* (2013.01); *B65D 2519/00029* (2013.01); *B65D 2519/00094* (2013.01); *B65D 2519/00104* (2013.01); *B65D 2519/00273* (2013.01); *B65D 2519/00293* (2013.01); *B65D 2519/00323* (2013.01); *B65D 2519/00373* (2013.01); *B65D 2519/00572* (2013.01)

(58) Field of Classification Search
CPC ..... B65D 19/0071; B65D 2519/00029; B65D 2519/00094; B65D 2519/00104; B65D 2519/00273; B65D 2519/00293; B65D 2519/00323; B65D 2519/00373; B65D 2519/00572
USPC ..... 108/57.17
See application file for complete search history.

(56) References Cited

U.S. PATENT DOCUMENTS

| | | | | |
|---|---|---|---|---|
| 2,503,022 A | | 4/1950 | Benoist et al. | |
| 2,922,606 A | * | 1/1960 | Glassman | B65D 19/0095 108/56.1 |
| 3,651,769 A | | 3/1972 | Foley | |
| 4,128,253 A | * | 12/1978 | Powers | B65D 19/0012 108/55.1 |
| 4,267,781 A | * | 5/1981 | Powers | B65D 19/0012 108/56.1 |

(Continued)

FOREIGN PATENT DOCUMENTS

| | | |
|---|---|---|
| CN | 1833958 | 9/2006 |
| CN | 101016094 | 8/2007 |

(Continued)

*Primary Examiner* — Daniel J Troy
*Assistant Examiner* — Timothy M Ayres
(74) *Attorney, Agent, or Firm* — Allen, Dyer, Doppelt + Gilchrist, PA

(57) ABSTRACT

A pallet includes a base layer and a cargo layer. The cargo layer includes a pair of spaced apart end deck boards, and intermediate deck boards between the pair of spaced apart end deck boards. Each end deck board and an immediately adjacent intermediate deck board are butted against one another. Spaced apart supports are coupled between the base and cargo layers and forming a gap therebetween for receiving a lifting member.

19 Claims, 8 Drawing Sheets

(56) References Cited

U.S. PATENT DOCUMENTS

| | | | | | |
|---|---|---|---|---|---|
| 4,292,900 | A * | 10/1981 | Bula | B65D 19/0012 | 108/57.1 |
| 4,485,744 | A | 12/1984 | Umemura et al. | | |
| 5,351,628 | A * | 10/1994 | Breezer | B65D 19/0022 | 108/56.1 |
| 6,584,915 | B1 * | 7/2003 | Rogers | F16B 15/06 | 108/56.1 |
| 8,261,673 | B2 * | 9/2012 | Ingham | B65D 19/0095 | 108/51.11 |
| 8,627,773 | B2 * | 1/2014 | Storteboom | B23P 11/00 | 108/51.11 |
| 8,667,905 | B2 * | 3/2014 | Anderson | B65D 19/0095 | 108/51.11 |
| 9,032,884 | B2 * | 5/2015 | Leen | B65D 19/0095 | 108/56.1 |
| 9,340,320 | B2 * | 5/2016 | Brandt | B65D 19/0095 | |
| 9,409,673 | B2 * | 8/2016 | Brandt | B65D 19/0095 | |
| 9,776,762 | B2 * | 10/2017 | De Beer | B65D 19/0095 | |
| 10,501,230 | B2 * | 12/2019 | Lantz | B65D 19/0095 | |
| 2005/0145145 | A1 | 7/2005 | Ogburn | | |
| 2006/0005746 | A1 * | 1/2006 | Gouldin, Jr. | B65D 19/0091 | 108/51.11 |
| 2009/0320723 | A1 | 12/2009 | Low | | |
| 2011/0005435 | A1 * | 1/2011 | Renck | B65D 19/0095 | 108/57.17 |
| 2012/0260832 | A1 | 10/2012 | Linares | | |
| 2015/0210425 | A1 | 7/2015 | Miller | | |
| 2015/0360809 | A1 * | 12/2015 | McBride | B65D 19/0095 | 108/57.19 |
| 2017/0275050 | A1 | 9/2017 | Pang | | |
| 2018/0162588 | A1 | 6/2018 | Segerstrom | | |

FOREIGN PATENT DOCUMENTS

| | | | |
|---|---|---|---|
| CN | 202072066 | | 12/2011 |
| CN | 103068688 | | 4/2013 |
| CN | 106379627 | | 2/2017 |
| CN | 107061454 | | 8/2017 |
| CN | 206782303 | | 12/2017 |
| DE | 9411879 | | 1/1998 |
| DE | 202012005056 | | 8/2012 |
| DE | 202012009242 | | 11/2012 |
| DE | 202013007560 | | 10/2013 |
| EP | 0673845 | | 9/1995 |
| EP | 1 232 952 | * | 8/2002 |
| EP | 1232952 | | 8/2002 |
| EP | 2671815 | | 12/2013 |
| EP | 3 093 250 | * | 11/2016 |
| GB | 2288783 | * | 1/1995 |
| JP | 2009040436 | | 2/2009 |
| WO | WO9113810 | | 9/1991 |
| WO | WO 97/43186 | * | 11/1997 |
| WO | WO 2004/106179 | * | 9/2004 |

* cited by examiner

WOODEN PALLET WITH BUTTED DECK BOARDS AND METAL BRACKET SUPPORTS

RELATED APPLICATION

This application claims the benefit of provisional application Ser. No. 62/702,430 filed Jul. 24, 2018, which is hereby incorporated herein in its entirety by reference.

TECHNICAL FIELD

The present disclosure relates to the field of pallets, and more particularly, to a wooden pallet having an improved resilience to impacts from material handling equipment.

BACKGROUND

Conventional wooden pallets include a base layer and a cargo layer separated by support blocks. The cargo layer traditionally has end deck boards assembled on connector boards that run the full length or width of the pallet. The end deck boards are nailed through the connector boards into the support blocks to build the primary structure of the pallet. The end deck boards are also known as lead boards. Intermediate deck boards are placed between the end deck boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

SUMMARY

A pallet includes a base layer, a cargo layer and a plurality of spaced apart supports coupled between the base and cargo layers and forming a gap therebetween for receiving a lifting member.

The cargo layer includes a pair of spaced apart outer connector boards, and at least one center connector board between the pair of outer connector boards. A pair of spaced apart end deck boards is on the pair of outer connector boards and the at least one center connector board, with the end deck boards being orthogonal to the outer connector boards and the at least one center connector board. A pair of spaced apart intermediate deck boards is on the pair of connector boards and the at least one center connector board, with the intermediate deck boards being orthogonal to the outer connector boards and the at least one center connector board and butted against a respective end deck board.

The spaced apart supports coupled between the base and cargo layers include outer supports and center supports. The outer supports may be configured as a C-shaped brackets having an upper flange contacting one of the outer connector boards and a bottom flange contacting the base layer. The center supports may be configured as circular-shaped cylinders having an upper surface contacting the at least one center connector board and a bottom surface contacting the base layer.

The outer supports may comprise metal and the center supports may comprise plastic. The outer and center connector boards may comprise wood, and the end and intermediate deck boards may comprise wood. The intermediate deck boards and the end deck boards may have a same width.

The cargo layer may further comprise at least one additional intermediate deck board between the pair of intermediate deck boards, with the at least one additional intermediate deck board being spaced from the pair of intermediate deck boards.

The base layer may comprise a pair of spaced apart bottom end deck boards, and at least one bottom center deck board between the pair of bottom end deck boards, and wherein the bottom flange of each outer support may contact one of the bottom end deck boards or the at least one bottom center deck board.

The bottom end deck boards and the at least one bottom center deck board may be aligned with the end deck boards and the intermediate deck boards in the cargo layer.

Each circular-shaped cylinder may comprise a center hub with an opening extending therethrough, an outer wall, and a plurality of ribs extending between the center hub and the outer wall. The plurality of ribs may be recessed from opposing ends of the center hub and the outer wall.

The base and cargo layers may include fastener openings aligned with the openings in the center hubs in the center supports, and the pallet may further include a plurality of fasteners for coupling the base and cargo layers to the center supports.

The upper flange in each outer support may include a single fastener opening extending therethrough, and the bottom flange in each outer support may include a pair of fastener openings extending therethrough. The base and cargo layers may include fastener openings aligned with the openings in the outer supports, and the pallet may further comprises a plurality of fasteners for securing the base and cargo layers to the outer supports.

Another aspect is directed to a method for making a pallet as described above.

DETAILED DESCRIPTION

Figure 1:
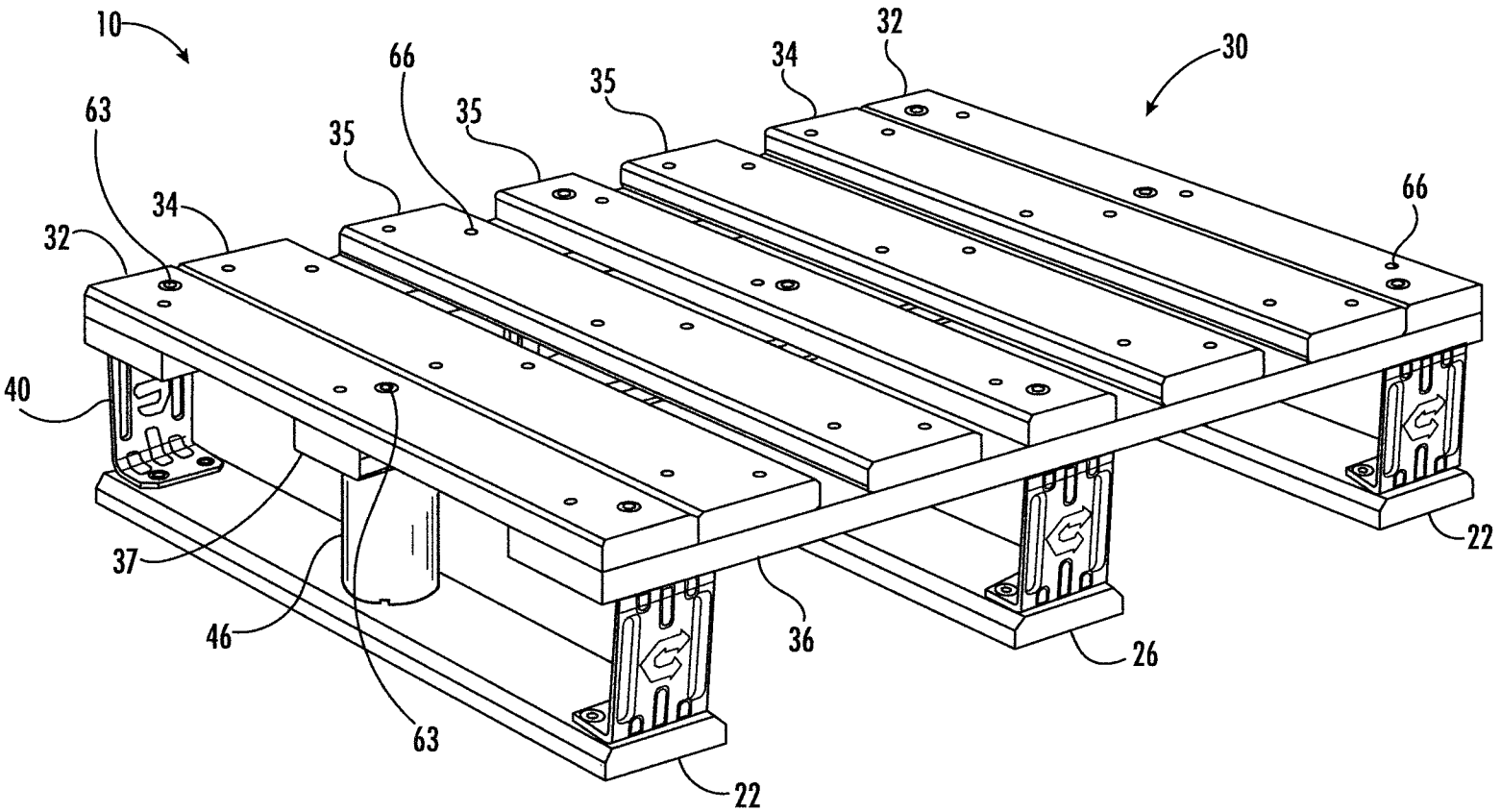
FIG. 1 is a top perspective view of a wooden pallet with butted deck boards in accordance with the disclosure.
Figure 2:
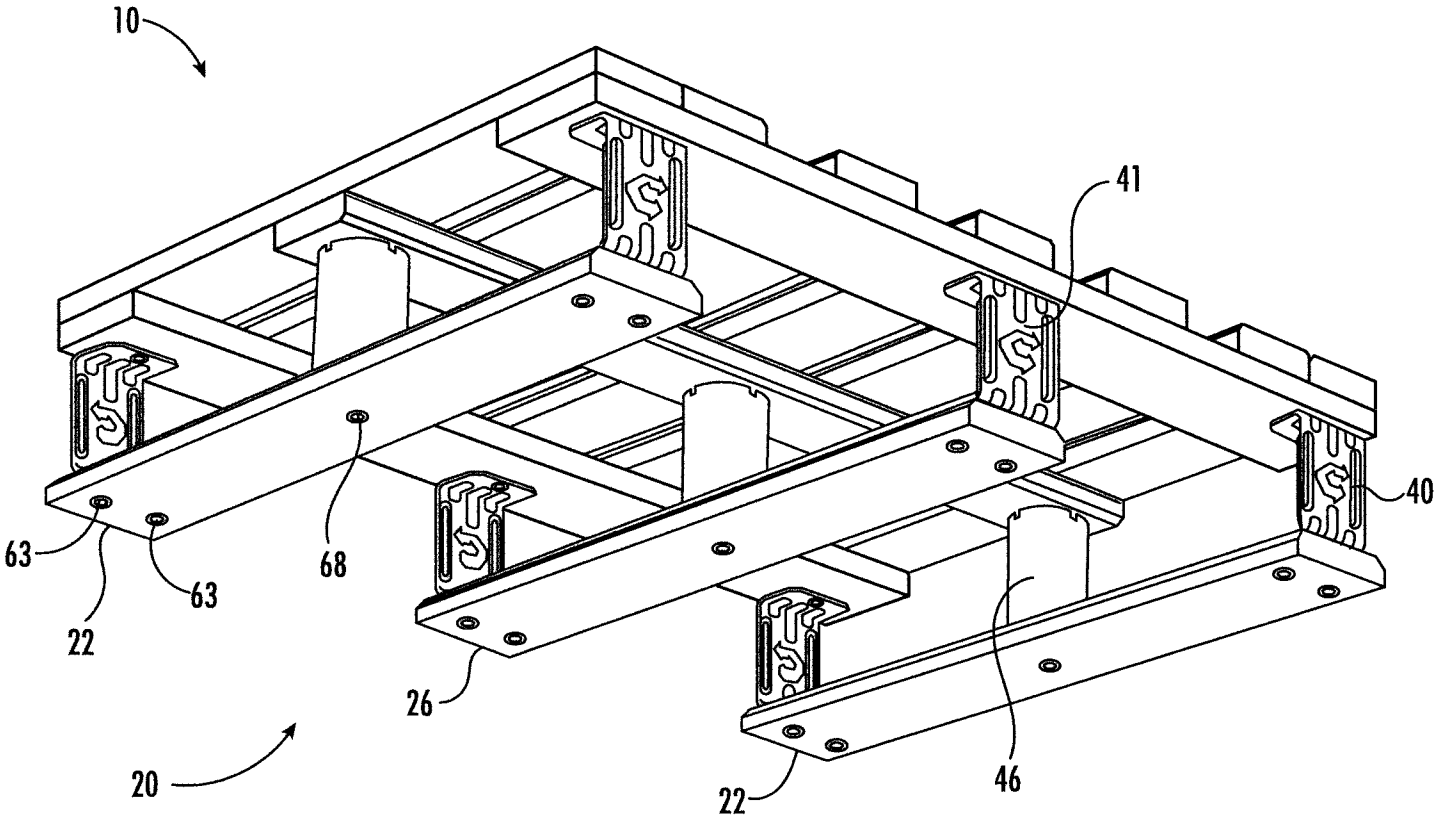
FIG. 2 is a bottom perspective view of the wooden pallet shown in FIG. 1.
Figure 3:
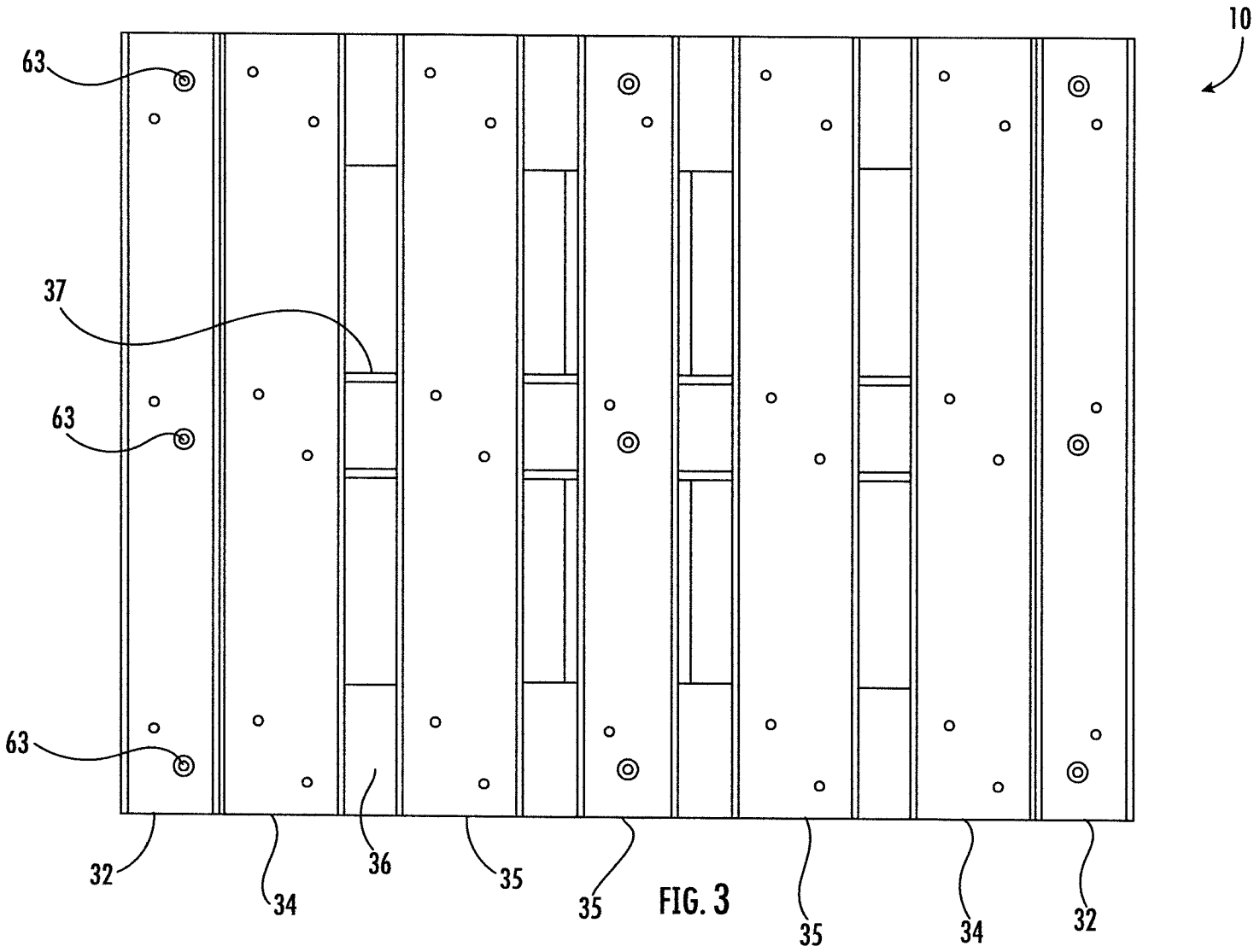
FIG. 3 is a top view of the wooden pallet shown in FIG. 1.
Figure 4:
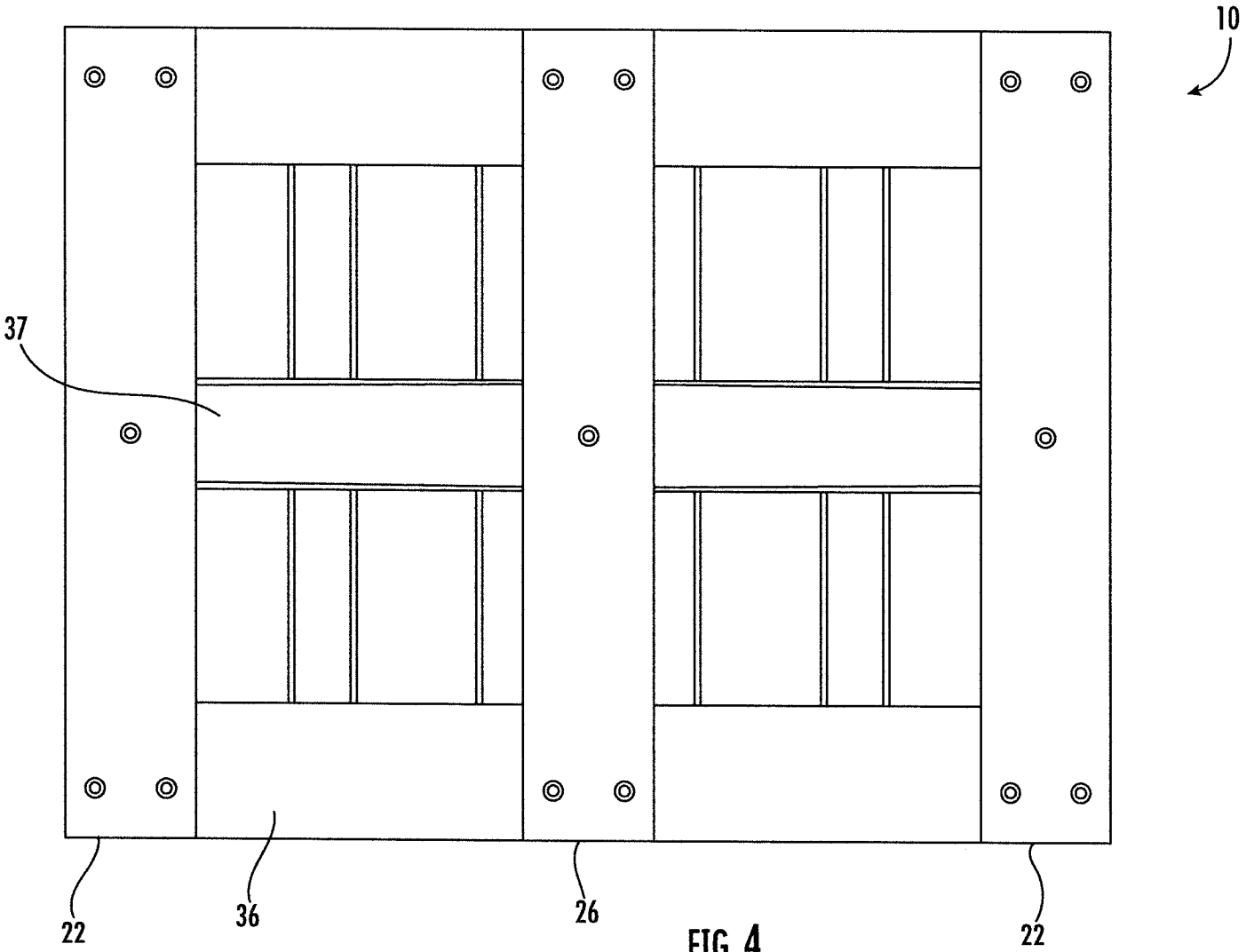
FIG. 4 is a bottom view of the wooden pallet shown in FIG. 1.
Figure 5:
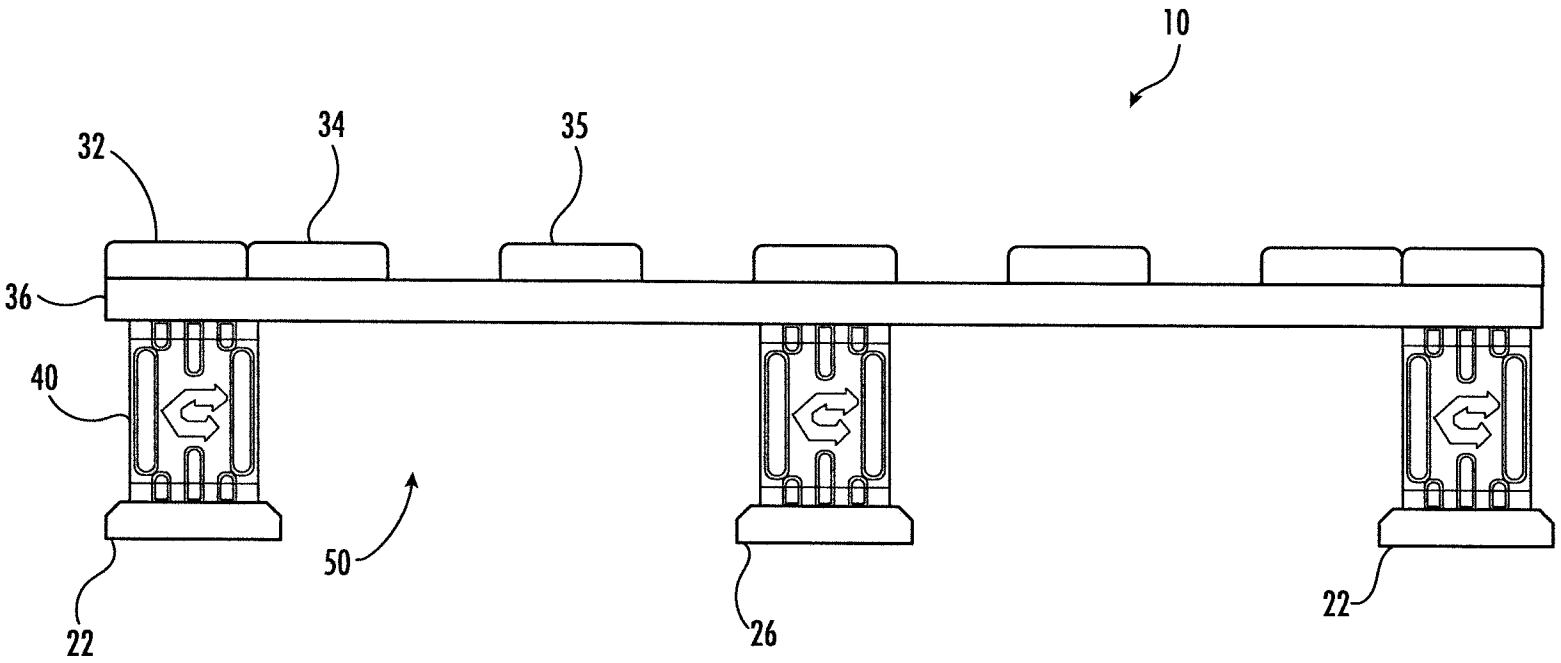
FIG. 5 is a side view of the wooden pallet shown in FIG. 1.
Figure 6:
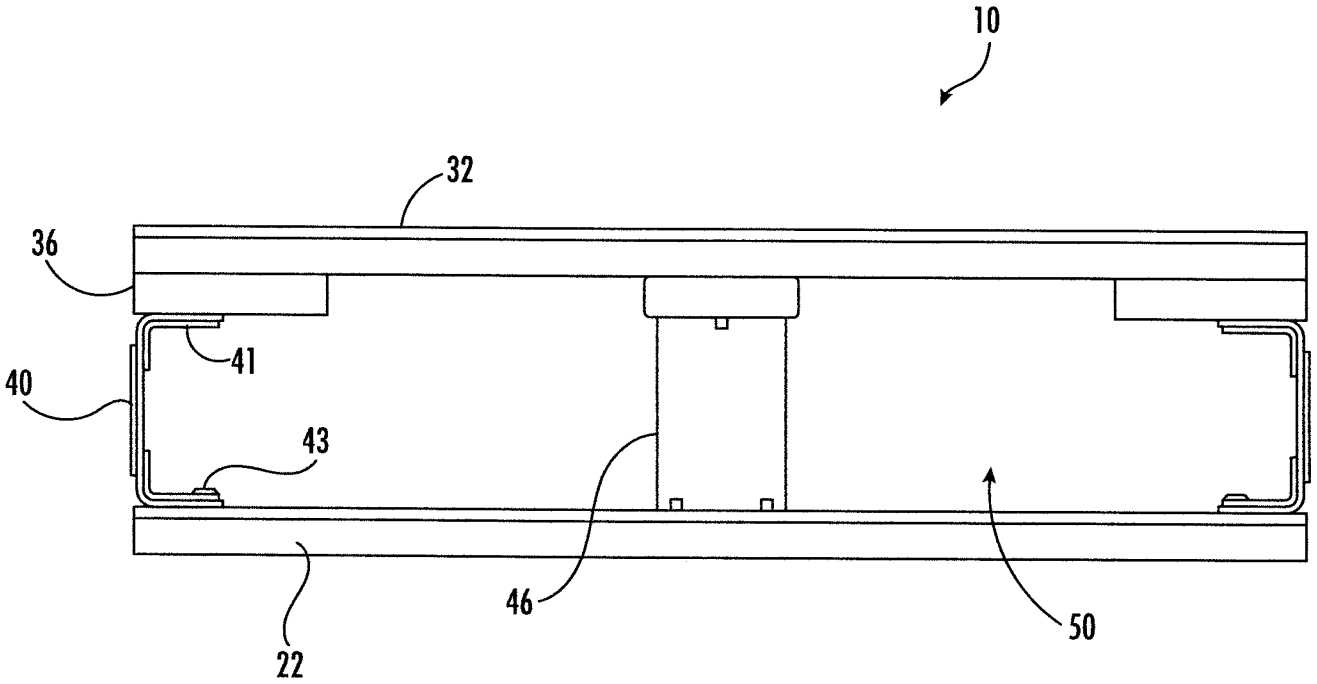
FIG. 6 is an end view of the wooden pallet shown in FIG. 1.

The present description is made with reference to the accompanying drawings, in which exemplary embodiments are shown. However, many different embodiments may be used, and thus the description should not be construed as limited to the particular embodiments set forth herein.

Rather, these embodiments are provided so that this disclosure will be thorough and complete. Like numbers refer to like elements throughout.

Referring to FIGS. 1-6, the illustrated wooden pallet 10 includes a base layer 20, a cargo layer 30, and a plurality of supports 40, 46 coupled between the base and cargo layers. The supports 40, 46 form a gap 50 between the base and cargo layers 20, 30 for receiving a lifting member, such as fork lift tines.

The cargo layer 30 includes a pair of spaced apart wooden end deck boards 32, and a pair of wooden intermediate deck boards 34 between the end deck boards. More particularly, each end deck board 32 and an immediately adjacent intermediate deck board 34 are butted against one another. Pallet durability is significantly improved by having the end deck boards 32 butt up against the immediately adjacent intermediate deck boards 34.

Also included within the cargo layer 30 is a pair of spaced apart wooden connector boards 36 and a wooden intermediate connector board 37. The connector boards 36 and the intermediate connector board 37 are orthogonal to the end deck boards 32 and the intermediate deck boards 34. The end deck boards 32 and the intermediate deck boards 34 are positioned on the connector boards 36.

The base layer 20 includes bottom deck boards 22, 26 orientated in the same direction as the end deck boards 32 and the intermediate deck boards 34 in the cargo layer 30. The bottom deck boards 22, 26 are directly coupled to the supports 40, 46.

Figure 7:
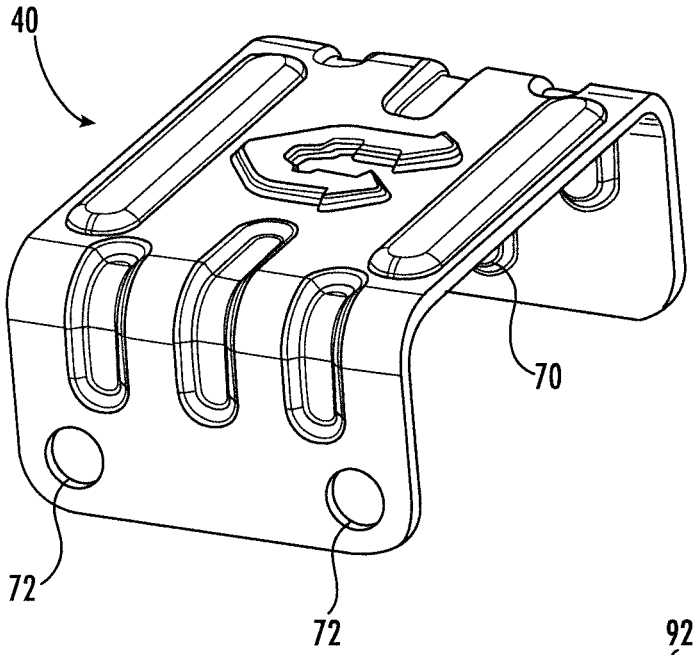
FIG. 7 is a perspective view of one of the metal bracket outer supports shown in FIG. 1.
Figure 8:
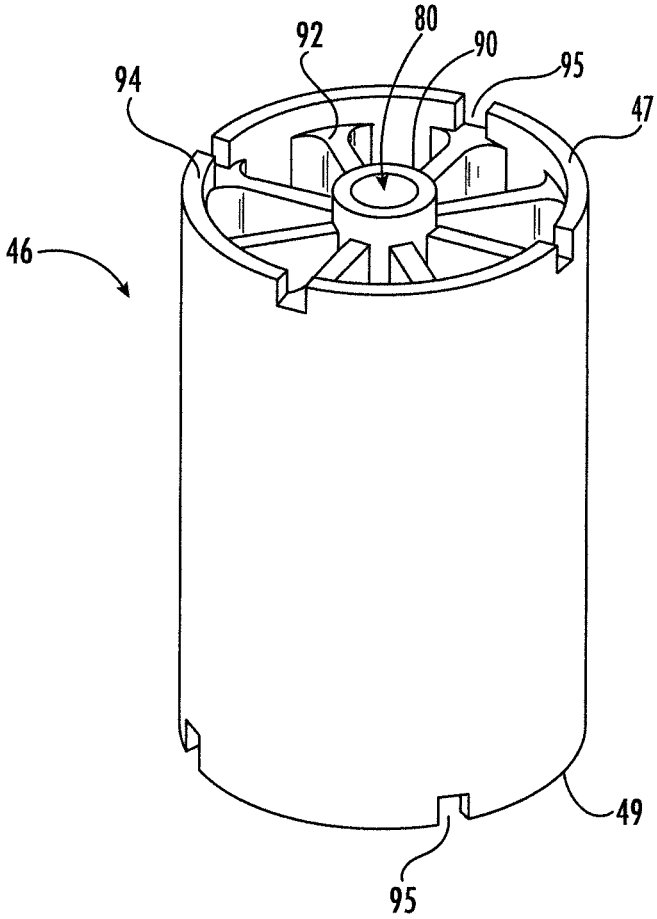
FIG. 8 is a perspective view of one of the plastic cylinder center supports shown in FIG. 1.

The supports include outer supports 40 and center supports 46 between the outer supports 40. The outer supports 40 are configured as metal brackets having a C-shape or U-shape as illustrated in FIG. 7. The center supports 46 are configured as circular-shaped plastic cylinders as illustrated in FIG. 8.

Bolts are used to secure the supports 40, 46 to the corresponding boards in the base and cargo layers 20, 30. A single respective bolt 63 is used for each support 40, 46 when securing to the cargo layer 30. For the base layer 20, a pair of respective bolts 63 is used for each outer support 40 and the same single respective bolt 63 is used for each center support 46 when securing to the base layer 20.

For the metal bracket outer supports 40, a single bolt opening 70 is in the cargo layer facing side, and a pair of bolt openings 72 is in the base layer facing side. For the plastic cylinder center supports 46, a single bolt opening 80 is in the cargo and base layer facing sides. The plastic cylinder center support 46 includes a center hub 90 that includes the bolt opening 80, and ribs 92 radially extending from the center hub 90 to an outer wall 94. The ribs 92 may be recessed from opposing ends 47, 49 of the center hub 90 and the outer wall 94. Notches or openings 95 are provided at the opposing ends 47, 49 to drain any liquids that may get inside of the plastic cylinder center support 46.

Figure 9:
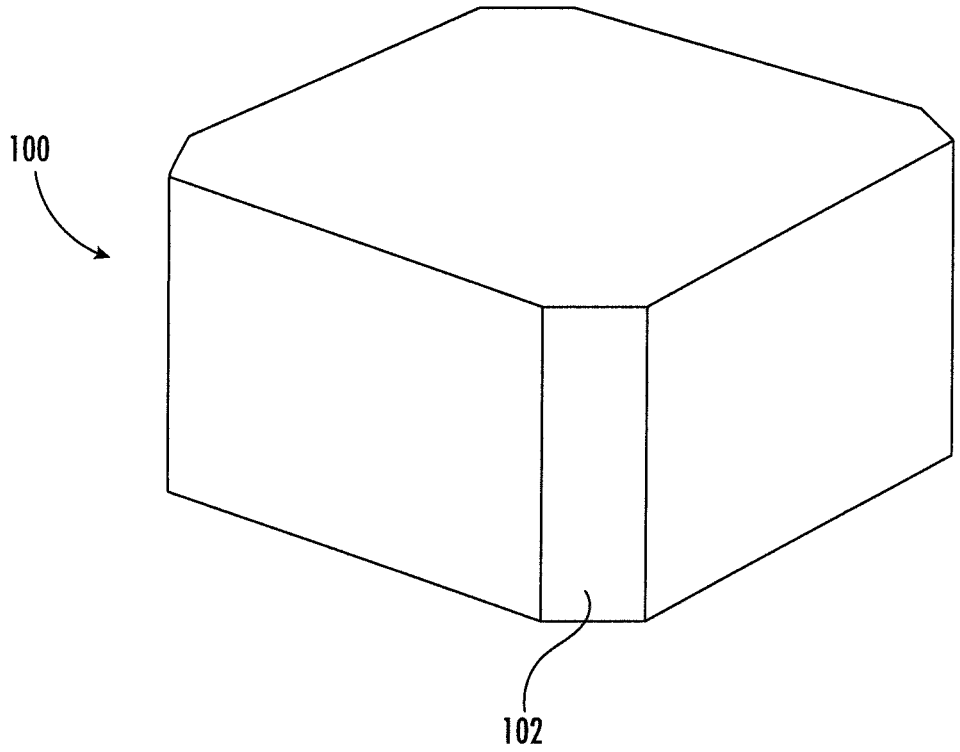
FIG. 9 is a perspective view of a wooden block support as an alternative to the supports shown in FIG. 1.

As an alternative to the metal bracket outer supports 40 and the plastic cylinder center support 46, wooden block supports 100 may be used as illustrated in FIG. 9. In other embodiments, wooden block supports 100 may be used to replace the outer supports 40 while the center supports 46 remain, or may be used to replace the center supports 46 while the outer supports 40 remain.

Nails 66 are used to couple adjacent boards together in the cargo layer 30. The nails 66 are used to secure the end deck boards 32, the intermediate deck boards 34 and additional intermediate deck boards 35 to the connector boards 36 and the intermediate connector board 37. The nails may be clinched nails, particularly in the butted intermediate deck boards 34.

The edges of each wooden support 100 may be angled or chamfered. The angled edges 102 may be within a range of about 25 to 75 degrees, for example, to deflect the impact force of the forklift tines should such an impact occur. The illustrated edges are angled at 45 degrees.

In the illustrated wooden pallet 10, a size of each end deck board 32 and a corresponding intermediate deck board 34 butted thereagainst have the same dimensions. For example, a width of the end deck board 32 and the intermediate deck board 34 butted thereagainst may be 145 mm, for example. In another example, the width may be 78 mm.

In other embodiments, the size of each end deck board 32 and a corresponding intermediate deck board 34 have different dimensions. For example, the width of the end deck board 32 may be 78 mm and the width of the corresponding intermediate deck board 34 may be 98 mm.

Traditionally, the intermediate deck boards in wooden pallets have a width that is less than a width of the end deck boards. In addition, traditionally there is a gap between the end deck boards and the adjacent intermediate deck boards. In the illustrated wooden pallet 10, pallet durability is significantly improved when there is no gap between the end deck boards 32 and the immediately adjacent intermediate deck boards 34, particularly with the end deck boards 32 and the immediately adjacent intermediate deck boards 34 having a same width.

The cargo layer 30 also includes at least one additional intermediate deck board 35 positioned between the intermediate deck boards 34 that are butted against the end deck boards 32. The additional intermediate deck boards 35 are positioned so that there is a gap between the adjacent intermediate deck boards 34. The dimensions of the end deck boards 32 and the intermediate deck boards 34 as well as additional intermediate deck boards 35 positioned between the intermediate deck boards 34 are selected and spaced such that coverage of the cargo layer 30 is within a range of 70-85 percent of a maximum total surface area of the cargo layer 30 when there are no gaps between the boards.

A width of the intermediate deck boards 35 may be the same as a width of the intermediate deck boards 34 butted against the end deck boards 32. Alternatively, in other embodiments, the intermediate deck boards 35 may have different widths. In addition, the boards making up the intermediate deck boards 35 may have different widths. For example, one of the intermediate deck boards 35 may have a width of 98 mm and another one of the intermediate deck boards 35 may have a width of 78 mm.

Another aspect is directed to a method for making a pallet 10 as described above. The method includes providing a base layer 20, and providing a cargo layer 30. The cargo layer 30 includes a pair of spaced apart outer connector boards 36, and at least one center connector board 37 between the pair of outer connector boards 36. A pair of spaced apart end deck boards 32 is on the pair of outer connector boards 36 and the at least one center connector board 37, with the end deck boards 32 being orthogonal to the outer connector boards 36 and the at least one center connector board 37. A pair of spaced apart intermediate deck boards 34 is on the pair of connector boards 36 and the at least one center connector board 37, with the intermediate deck boards 34 being orthogonal to the outer connector boards 36 and the at least one center connector board 37 and butted against a respective end deck board 32.

The spaced apart supports are coupled between the base and cargo layers 20, 30. The supports include outer supports 40 and center supports 46. The outer supports 40 are configured as a C-shaped bracket having an upper flange 41 contacting one of the outer connector boards 36 and a bottom flange 43 contacting the base layer 20. The center supports 46 are configured as a circular-shaped cylinder having an upper surface 47 contacting the at least one center connector board 37 and a bottom surface 49 contacting the base layer 20.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed:

1. A pallet comprising:

a base layer;

a cargo layer comprising a pair of spaced apart outer connector boards, at least one center connector board between said pair of outer connector boards, a pair of spaced apart end deck boards on said pair of cuter connector boards and said at least one center connector board, with said end deck boards being orthogonal to said outer connector boards and said at least one center connector board, and a pair of spaced apart intermediate deck boards on said pair of connector boards and said at least one center connector board, with said intermediate deck boards being orthogonal to said outer connector boards and said at least one center connector board and butted against a respective end deck board; and a plurality of spaced apart supports coupled between said base and cargo layers and forming a gap therebetween for receiving a lifting member, and comprising:

outer corner supports each configured as a C-shaped bracket having an upper flange with an outermost portion directly contacting an underside of one of said outer connector boards, a bottom flange with an outermost portion directly contacting an upper surface of said base layer, and a section extending between the upper and bottom flanges, with a width of the section being equal to a width of the upper and bottom flanges, and center supports each configured as a circular-shaped cylinder having an upper surface contacting said at least one center connector board and a bottom surface contacting said base layer, with each center support comprising:

an outer wall having opposing ends that include a plurality of spaced apart drainage notches, a center hub having opposing ends aligned with the opposing ends of said outer wall, and including an opening extending therethrough, and a plurality of ribs extending between said center hub and said outer wall, and having opposing ends aligned with the plurality of spaced apart drainage notches.

2. The pallet according to claim 1 wherein said outer supports comprise metal and said center supports comprise plastic.

3. The pallet according to claim 1 wherein said outer and center connector boards comprise wood, and wherein said end and intermediate deck boards comprise wood.

4. The pallet according to claim 1 wherein said intermediate deck boards and said end deck boards have a same width.

5. The pallet according to claim 1 wherein said cargo layer further comprises at least one additional intermediate deck board between said pair of intermediate deck boards, with said at least one additional intermediate deck board being spaced from said pair of intermediate deck boards.

6. The pallet according to claim 1 wherein said base layer comprises a pair of spaced apart bottom end deck boards, and at least one bottom center deck board between said pair bottom end deck boards, and wherein the bottom flange of each outer support contacts one of said bottom end deck boards or said at least one bottom center deck board.

7. The pallet according to claim 1 wherein said bottom end deck boards and said at least one bottom center deck board are aligned with said end deck boards and said intermediate deck boards in said cargo layer.

8. The pallet according to claim 1 wherein said base and cargo layers include fastener openings aligned with the openings in the center hubs in said center supports, and further comprising a plurality of fasteners for coupling said base and cargo layers to said center supports.

9. The pallet according to claim 1 wherein said plurality of ribs are recessed from opposing ends of said center hub and said outer wall.

10. The pallet according to claim 1 wherein the upper flange in each outer support includes a single fastener opening extending therethrough, and the bottom flange in each outer support includes a pair of fastener openings extending therethrough; and said base and cargo layers include fastener openings aligned with the openings in said outer supports, and further comprising a plurality of fasteners for securing said base and cargo layers to said outer supports.

11. A method for making a pallet comprising:

providing a base layer;

providing a cargo layer comprising a pair of spaced apart outer connector boards, at least one center connector board between the pair of outer connector boards, a pair of spaced apart end deck boards on the pair of outer connector boards and the at least one center connector board, with the end deck boards being orthogonal to the outer connector boards and the at least one center connector board, and a pair of spaced apart intermediate deck boards on the pair of connector boards and the at least one center connector board, with the intermediate deck boards being orthogonal to the outer connector boards and the at least one center connector board and butted against a respective end deck board; and coupling a plurality of spaced apart supports between the base and cargo layers and forming a gap therebetween for receiving a lifting member, with the supports comprising:

outer corner supports each configured as a C-shaped bracket having an upper flange with an outermost portion directly contacting an underside of one of the outer connector boards, a bottom flange with an outermost portion directly contacting an upper surface of the layer, and a section extending between the upper and bottom flanges, with a width of the section being equal to a width of the upper and bottom flanges, and center supports each configured as a circular-shaped cylinder having an upper surface contacting the at least one center connector board and a bottom surface contacting the base layer, with each center support comprising:

an outer wall having opposing ends that include a plurality of spaced apart drainage notches, a center hub having opposing ends aligned with the opposing ends of the outer wall, and including an opening extending therethrough, and a plurality of ribs extending between the center hub and the outer wall, and having opposing ends aligned with the plurality of spaced apart drainage notches.

12. The method according to claim 11 wherein the cuter supports comprise metal and the center supports comprise plastic.

13. The method according to claim 11 wherein the outer and center connector boards comprise wood, and wherein the end and intermediate deck boards comprise wood.

14. The method according to claim 11 wherein the intermediate deck boards and the end deck boards have a same width.

15. The method according to claim 11 wherein the cargo layer further comprises at least one additional intermediate deck board between the pair of intermediate deck boards, with the at least one additional intermediate deck board being spaced from the pair of intermediate deck boards.

16. The method according to claim 11 wherein the base layer comprises a pair of spaced apart bottom end deck boards, and at least one bottom center deck board between the pair of bottom end deck boards, and wherein the bottom flange of each outer support contacts one of the bottom end deck boards or the at least one bottom center deck board.

17. The method according to claim 16 wherein the bottom end deck boards and the at least one bottom center deck board are aligned with the end deck boards and the intermediate deck boards in the cargo layer.

18. The method according to claim 11 wherein the plurality of ribs are recessed from opposing ends of the center hub and the outer wall.

19. The method according to claim 18 wherein the base and cargo layers include fastener openings aligned with the openings in the center hubs in the center supports, and further comprising a plurality of fasteners for coupling the base and cargo layers to the center supports.

* * * * *